US005794720A

United States Patent [19]

Smith et al.

[11] Patent Number: 5,794,720

[45] Date of Patent: Aug. 18, 1998

[54] METHOD OF ASSAYING DOWNHOLE OCCURRENCES AND CONDITIONS

[75] Inventors: Lee Morgan Smith; William A. Goldman, both of Houston, Tex.

[73] Assignee: Dresser Industries, Inc., Dallas, Tex.

[21] Appl. No.: 621,411

[22] Filed: Mar. 25, 1996

[51] Int. Cl.[6] ..... E21B 45/00

[52] U.S. Cl. ..... 175/40; 73/152.44; 175/39

[58] Field of Search ..... 175/39, 40; 73/152.48, 73/152.47, 152.44, 152.45, 152.43

[56] References Cited

U.S. PATENT DOCUMENTS

| | | | |
|---|---|---|---|
| 3,752,966 | 8/1973 | Foy, Jr.et al. | 175/40 X |
| 4,064,749 | 12/1977 | Pittman et al. | 73/152 |
| 4,627,276 | 12/1986 | Burgess et al. | 73/151 |
| 4,685,329 | 8/1987 | Burgess | 73/151 |
| 4,694,686 | 9/1987 | Fildes et al. | 73/104 |
| 4,845,628 | 7/1989 | Gray et al. | 73/152.44 |
| 4,914,591 | 4/1990 | Warren et al. | 364/422 |
| 4,926,686 | 5/1990 | Fay | 175/39 X |
| 5,305,836 | 4/1994 | Holbrook et al. | 175/39 |
| 5,415,030 | 5/1995 | Jogi et al. | 175/39 X |
| 5,449,047 | 9/1995 | Shivley, Jr. | 175/27 |

FOREIGN PATENT DOCUMENTS 0 466 255 A2 1/1992 European Pat. Off. .

OTHER PUBLICATIONS

Philip Holbrook, Michael Hauck; Petrophysical—Mechanical Math Model Real-time Wellsite Poor Pressure/Fracture Gradient Prediction *Society of Petroleum Engineers (STE)* Pub. No. 16666, Published Sep., 1987 in Dallas, Texas.

Kenneth L. Mason; 3-Cone Bit Selection with Sonic Logs pp. 135–142, *SPE Drilling Engineering*, Jun. 1987, first published Sep. 1984 in Houston, Texas.

E.M. Galle and H.B. Woods; Best Constant Weight and Rotary Speed for Rotary Rock Bits pp. 48–73, *API Drilling and Production Practice*, 1963.

R. Teale; The Concept of Specific Energy in Rock Drilling pp. 57–73, *International Journal of Rock Mechanics*, Mining Sciences, vol. 2, 1965, Great Britain.

D.A. Glowka; Use of Single-Cutter Data in the Analysis of PDC Bit Designs: Part II—Development and Use of PDCWEAR Computer Code pp. 850–859, *JPT* (Aug. 1989).

David A. Glowka; Use of Single-Cutter Data in the Analysis of PDC Bit Designs: Part I—Development of a PDC Cutting Force Model pp. 797–849, *JPT* (Aug. 1989).

R.C. Pessier, M.J. Fear; Quantifying Common Drilling Problems with Mechanical Specific Energy and a Bit-Specific Coeffecient of Sliding Friction pp. 373–388, *SPE Paper* 24584, published Oct. 1982, Washington, D.C. .

(List continued on next page.)

*Primary Examiner*—Hoang C. Dang

*Attorney, Agent, or Firm*—Browning Bushman

[57] ABSTRACT

A method of assaying work of an earth boring bit of a given size and design comprises the steps of drilling a hole with the bit from an initial point to a terminal point and recording the distance between the initial and terminal points. A plurality of electrical incremental actual force signals are generated, each corresponding to a force of the bit over a respective increment of the distance between the initial and terminal points. A plurality of electrical incremental distance signals are also generated, each corresponding to the length of the increment for a respective one of the incremental actual force signals. The incremental actual force signals and the incremental distance signals are processed to produce a value corresponding to the total work done by the bit in drilling from the initial point to the terminal point. Using such a basic work assay, a number of other downhole occurrences and/or conditions can be assayed. These include a wear rating for the type of bit, a determination of whether such a bit can drill a given interval of formation, and assessment of the abrasivity of rock drilled (which in turn can be used to modify the assays of other conditions and/or occurrences), a model of the wear of such a bit in current use, and a determination of the mechanical efficiency of the bit.

47 Claims, 4 Drawing Sheets

OTHER PUBLICATIONS

T.M. Burgess, W.C. Lesso; Measuring the Wear of Milled Tooth Bits Using MWD Torque and Weight–on–Bit *SPE/IADC* 13475, pp. 453–458 for pages illustration, published Mar. 1985, New Orleans, Louisiana.

Allen D. Gault; Measurement of Drilling Properties pp. 143–148, *SPE Drilling Engineer,* Jun. 1987, published New Orleans, Louisiana (Mar. 1985).

J.P.R. Sparr and L.W. Ledgerwood, Harvey Goodman, R.L. Graff and T.J. Moo; Formation Compressive Strength Estimates for Predicting Drillability and PDC Bit Selection pp. 569–578, *SPE/IADC* 29397, published Feb. 1995, Amsterdam, Netherlands.

E. Detournay, P. Defourny; A Phenomenological Model for the Drilling Action of Drag Bits pp. 13–23, *International Journal of Rock Mechanics, Mineral Sciences and Geomechanical Abstracts,* vol. 29, No. 1, 1992, printed in Great Britain.

METHOD OF ASSAYING DOWNHOLE OCCURRENCES AND CONDITIONS

CROSS REFERENCE TO RELATED APPLICATIONS

This application is related to U.S. Pat. application Ser. No. 08/621,412 entitled METHOD OF ASSAYING STRENGTH OF ROCK and U.S. Pat. application Ser. No. 08/621,414 entitled METHOD OF REGULATING DRILLING CONDITIONS APPLIED TO A WELL BIT, both of such applications being filed contemporaneously with the present application and naming the same inventors as the present application.

BACKGROUND OF THE INVENTION

From the very beginning of the oil and gas well drilling industry, as we know it, one of the biggest challenges has been the fact that it is impossible to actually see what is going on downhole. There are any number of downhole conditions and/or occurrences which can be of great importance in determining how to proceed with the operation. It goes without saying that all methods for attempting to assay such downhole conditions and/or occurrences are indirect. To that extent, they are all less than ideal, and there is a constant effort in the industry to develop simpler and/or more accurate methods.

In general, the approach of the art has been to focus on a particular downhole condition or occurrence and develop a way of assaying that particular thing. For example, U.S. Pat. No. 5,305,836, discloses a method whereby the wear of a bit currently in use can be electronically modeled, based on the lithology of the hole being drilled by that bit. This helps the operator know when it is time to replace the bit.

The process of determining what type of bit to use in a given part of a given formation has, traditionally, been, at best, based only on very broad, general considerations, and at worst, more a matter of art and guess work than of science.

Other examples could be given for other kinds of conditions and/or occurrences.

Furthermore, there are still other conditions and/or occurrences which would be helpful to know. However, because they are less necessary, and in view of the priority of developing better ways of assaying those things which are more important, little or no attention has been given to methods of assaying these other conditions.

SUMMARY OF THE INVENTION

Surprisingly, to applicant's knowledge, no significant attention has been given to a method for assaying the work a bit does in drilling a hole from an initial point to a terminal point. The present invention provides a very pragmatic method of doing so. The particular method of the present invention is relatively easy to implement, and perhaps more importantly, the work assay provides a common ground for developing assays of many other conditions and occurrences.

More specifically, a hole is drilled with a bit of the size and design in question from an initial point to a terminal point. As used herein, "initial point" need not (but can) represent the point at which the bit is first put to work in the hole. Likewise, the "terminal point" need not (but can) represent the point at which the bit is pulled and replaced. The initial and terminal points can be any two points between which the bit in question drills, and between which the data necessary for the subsequent steps can be generated.

In any event, the distance between the initial and terminal points is recorded and divided into a number of, preferably small, increments. A plurality of electrical incremental actual force signals, each corresponding to the force of the bit over a respective increment of the distance between the initial and terminal points, are generated. A plurality of electrical incremental distances signals, each corresponding to the length of the increment for a respective one of the incremental actual force signals, are also generated. The incremental actual force signals and the incremental distance signals are processed by a computer to produce a value corresponding to the total work done by the bit in drilling from the initial point to the terminal point.

In preferred embodiments of the invention, the work assay may then be used to develop an assay of the mechanical efficiency of the bit as well as a continuous rated work relationship between work and wear for the bit size and design in question. These, in turn, can be used to develop a number of other things.

For example, the rated work relationship includes a maximum-wear-maximum-work point, sometimes referred to herein as the "work rating," which represents the total amount of work the bit can do before it is worn to the point where it is no longer realistically useful. This work rating, and the relationship of which it is a part, can be used, along with the efficiency assay, in a process of determining whether a bit of the size and design in question can drill a given interval of formation. Other bit designs can be similarly evaluated, whereafter an educated, scientific choice can be made as to which bit or series of bits should be used to drill that interval.

Another preferred embodiment of the invention using the rated work relationship includes a determination of the abrasivity of the rock drilled in a given section of a hole. This, in turn, can be used to refine some of the other conditions assayed in accord with various aspects of the present invention, such as the bit selection process referred to above.

The rated work relationship can also be used to remotely model wear of a bit in current use in a hole, and the determination of abrasivity can be used to refine this modeling if the interval the bit is drilling is believed, e.g. due to experiences with nearby "offset wells," to contain relatively abrasive rock.

DETAILED DESCRIPTION

Figure 1:
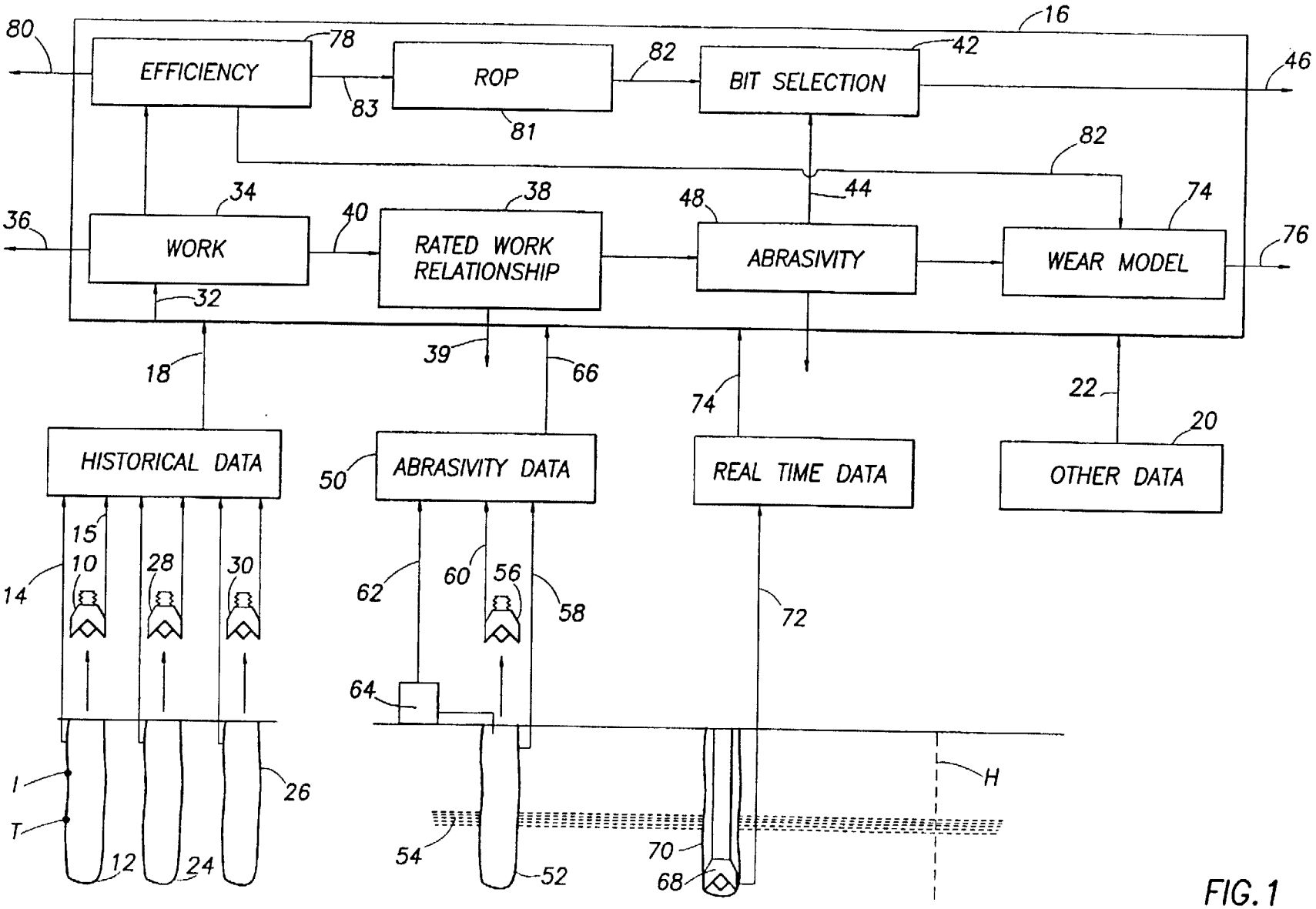
FIG. 1 is a diagram generally illustrating various processes which can be performed in accord with the present invention.

Referring to FIG. 1, the most basic aspect of the present invention involves assaying work of a well drilling bit 10 of a given size and design. A well bore or hole 12 is drilled, at least partially with the bit 10. More specifically, bit 10 will have drilled the hole 12 between an initial point I and a terminal point T. In this illustrative embodiment, the initial point I is the point at which the bit 10 was first put to work in the hole 12, and the terminal point T is the point at which the bit 10 was withdrawn. However, for purposes of assaying work per se, points I and T can be any two points which can be identified, between which the bit 10 has drilled, and between which the necessary data, to be described below, can be generated.

The basic rationale is to assay the work by using the well known relationship:

$$\Omega_b = F_b D \quad (1)$$

where:

$\Omega_b$=bit work $F_b$=total force at the bit

D=distance drilled

The length of the interval of the hole 12 between points I and T can be determined and recorded as one of a number of well data which can be generated upon drilling the well 12, as diagrammatically indicated by the line 14. To convert it into an appropriate form for inputting into and processing by the computer 16, this length, i.e. distance between points I and T, is preferably subdivided into a number of small increments of distance, e.g. of about one-half foot each. For each of these incremental distance values, a corresponding electrical incremental distance signal is generated and inputted into the computer 16, as indicated by line 18. As used herein, in reference to numerical values and electrical signals, the term "corresponding" will mean "functionally related," and it will be understood that the function in question could, but need not, be a simple equivalency relationship. "Corresponding precisely to" will mean that the signal translates directly to the value of the very parameter in question.

In order to determine the work, a plurality of electrical incremental actual force signals, each corresponding to the force of the bit over a respective increment of the distance between points I and T, are also generated. However, because of the difficulties inherent in directly determining the total bit force, signals corresponding to other parameters from the well data 14, for each increment of the distance, are inputted, as indicated at 18. These can, theoretically, be capable of determining the true total bit force, which includes the applied axial force, the torsional force, and any applied lateral force. However, unless lateral force is purposely applied (in which case it is known), i.e. unless stabilizers are absent from the bottom hole assembly, the lateral force is so negligible that it can be ignored.

In one embodiment, the well data used to generate the incremental actual force signals are:

weight on bit (w), e.g. in lb.;

hydraulic impact force of drilling fluid ($F_j$), e.g. in lb.;

rotary speed, in rpm (N);

torque (T), e.g. in ft.*lb.;

penetration rate (R), e.g. in ft./hr. and;

lateral force, if applicable ($F_L$), e.g. in lb.

With these data for each increment, respectively, converted to corresponding signals inputted as indicated at 18, the computer 16 is programmed or configured to process those signals to generate the incremental actual force signals to perform the electronic equivalent of solving the following equation:

$$\Omega_b = [(w+F_j)+120\pi NT/R+F_L]D \quad (2)$$

where the lateral force, $F_L$, is negligible, that term, and the corresponding electrical signal, drop out.

Surprisingly, it has been found that the torsional component of the force is the most dominant and important, and in less preferred embodiments of the invention, the work assay may be performed using this component of force alone, in which case the corresponding equation becomes:

$$\Omega_b = [120\pi NT/R]D \quad (3)$$

In an alternate embodiment, in generating the incremental actual force signals, the computer 16 may use the electronic equivalent of the equation:

$$\Omega_b = 2\pi T/d_c D \quad (4)$$

where d represents depth of cut per revolution, and is, in turn, defined by the relationship:

$$d_c = R/60N \quad (5)$$

The computer 16 is programmed or configured to then process the incremental actual force signals and the respective incremental distance signals to produce an electrical signal corresponding to the total work done by the bit 10 in drilling between the points I and T, as indicated at block 34. This signal may be readily converted to a humanly perceivable numerical value outputted by computer 16, as indicated by the line 36, in the well known manner.

The processing of the incremental actual force signals and incremental distance signals to produce total work 34 may be done in several different ways. For example:

In one version, the computer processes the incremental actual force signals and the incremental distance signals to produce an electrical weighted average force signal corresponding to a weighted average of the force exerted by the bit between the initial and terminal points. By "weighted average" is meant that each force value corresponding to one or more of the incremental actual force signals is "weighted" by the number of distance increments at which that force applied. Then, the computer simply performs the electronic equivalent of multiplying the weighted average force by the total distance between points I and T to produce a signal corresponding to the total work value.

In another version, the respective incremental actual force signal and incremental distance signal for each increment are processed to produce a respective electrical incremental actual work signal, whereafter these incremental actual work signals are cumulated to produce an electrical total work signal corresponding to the total work value.

In still another version, the computer may develop a force/distance function from the incremental actual force signals and incremental distance signals, and then perform the electronic equivalent of integrating that function.

Not only are the three ways of processing the signals to produce a total work signal equivalent, they are also exemplary of the kinds of alternative processes which will be considered equivalents in connection with other processes forming various parts of the present invention, and described below.

Technology is now available for determining when a bit is vibrating excessively while drilling. If it is determined that this has occurred over at least a portion of the interval between points I and T, then it may be preferable to suitably program and input computer 16 so as to produce respective incremental actual force signals for the increments in question, each of which corresponds to the average bit force for the respective increment. This may be done by using the average (mean) value for each of the variables which go into the determination of the incremental actual force signal.

Wear of a drill bit is functionally related to the cumulative work done by the bit. In a further aspect of the present invention, in addition to determining the work done by bit 10 in drilling between points I and T, the wear of the bit 10 in drilling that interval is measured. A corresponding electrical wear signal is generated and inputted into the computer as part of the historical data 15, 18. (Thus, for this purpose, point I should be the point the bit 10 is first put to work in the hole 12, and point T should be the point at which bit 10 is removed.) The same may be done for additional wells 24 and 26, and their respective bits 28 and 30.

Figure 2:
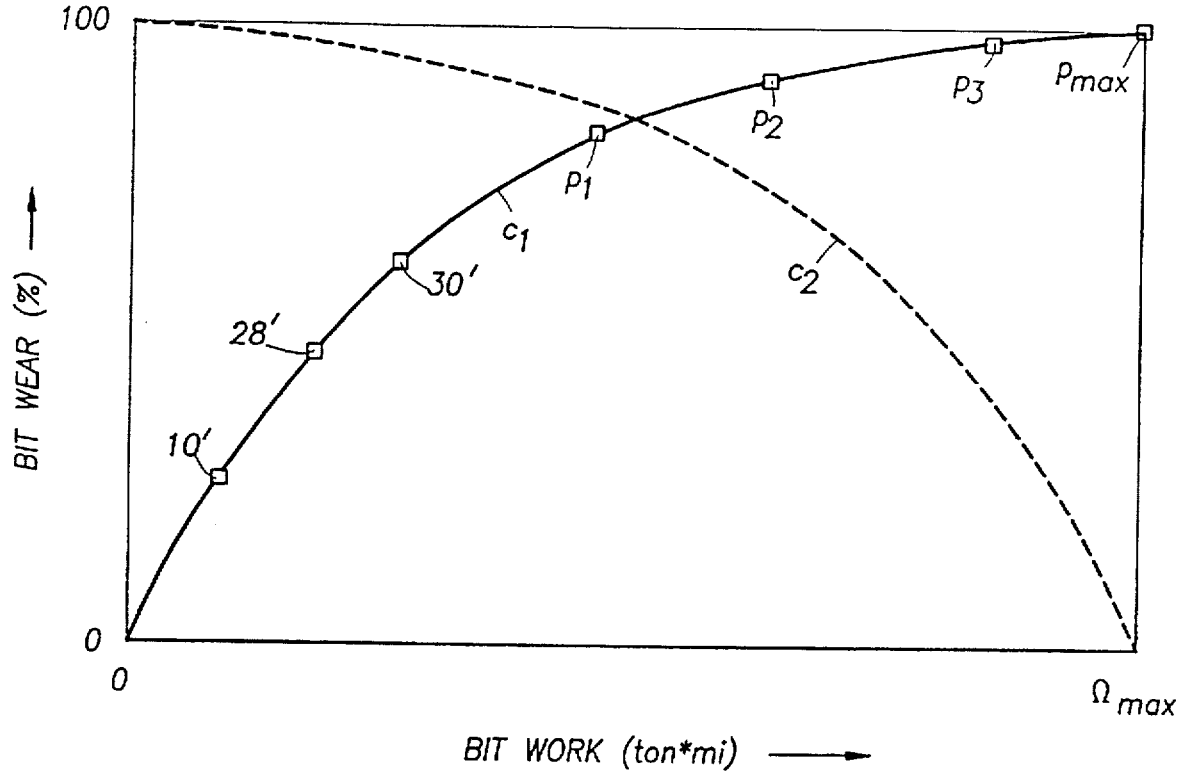
FIG. 2 is a graphic illustration of the rated work relationship.

FIG. 2 is a graphic representation of what the computer 16 can do, electronically, with the signals corresponding to such data. FIG. 2 represents a graph of bit wear versus work. Using the aforementioned data, the computer 16 can process the corresponding signals to correlate respective work and wear signals and perform the electronic equivalent of locating a point on this graph for each of the holes 12, 24 and 26, and its respective bit. For example, point 10' may represent the correlated work and wear for the bit 10, point 28' may represent the correlated work and wear for the bit 28, and point 30' may represent the correlated work and wear for the bit 30. Other points $p_1$, $p_2$ and $p_3$ represent the work and wear for still other bits of the same design and size not shown in FIG. 1.

By processing the signals corresponding to these points, the computer 16 can generate a function, defined by suitable electrical signals, which function, when graphically represented, takes the form of a smooth curve generally of the form of curve $c_1$ it will be appreciated, that in the interest of generating a smooth and continuous curve, such curve may not pass precisely through all of the individual points corresponding to specific empirical data. This continuous "rated work relationship" can be an output 39 in its own right, and can also be used in various other aspects of the invention to be described below.

It is helpful to determine an end point $p_{max}$ which represents the maximum bit wear which can be endured before the bit is no longer realistically useful and, from the rated work relationship, determining the corresponding amount of work. Thus, the point $p_{max}$ represents a maximum-wear-maximum-workpoint, sometimes referred to herein as the "work rating" of the type of bit in question. It may also be helpful to develop a relationship represented by the mirror image of curve $c_1$, i.e. curve $c_2$, which plots remaining useful bit life versus work done from the aforementioned signals.

The electrical signals in the computer which correspond to the functions represented by the curves $c_1$ and $c_2$ are preferably transformed into a visually perceptible form, such as the curves as shown in FIG. 2, when outputted at 39.

As mentioned above in another context, bit vibrations may cause the bit force to vary significantly over individual increments. In developing the rated work relationship, it is preferable in such cases, to generate a respective peak force signal corresponding to the maximum force of the bit over each such increment. A limit corresponding to the maximum allowable force for the rock strength of that increment can also be determined as explained below. For any such bit which is potentially considered for use in developing the curve $c_1$, a value corresponding to the peak force signal should be compared to the limit, and if that value is greater than or equal to the limit, the respective bit should be excluded from those from which the rated work relationship signals are generated. This comparison can, of course, be done electronically by computer 16, utilizing an electrical limit signal corresponding to the aforementioned limit.

The rationale for determining the aforementioned limit is based on an analysis of the bit power. Since work is functionally related to wear, and power is the rate of doing work, power is functionally related to (and thus an indication of) wear rate.

Since power, $$P = F_b D/t \quad (6)$$

$$= F_b R \quad (6a)$$

where t=time

R=penetration rate, a fundamental relationship also exists between penetration rate and power.

For adhesive and abrasive wear of rotating machine parts, published studies indicate that the wear rate is proportional to power up to a critical power limit above which the wear rate increases rapidly and becomes severe or catastrophic. The wear of rotating machine parts is also inversely proportional to the strength of the weaker material. The drilling process is fundamentally different from lubricated rotating machinery in that the applied force is always proportional to the strength of the weaker material.

Figure 7:
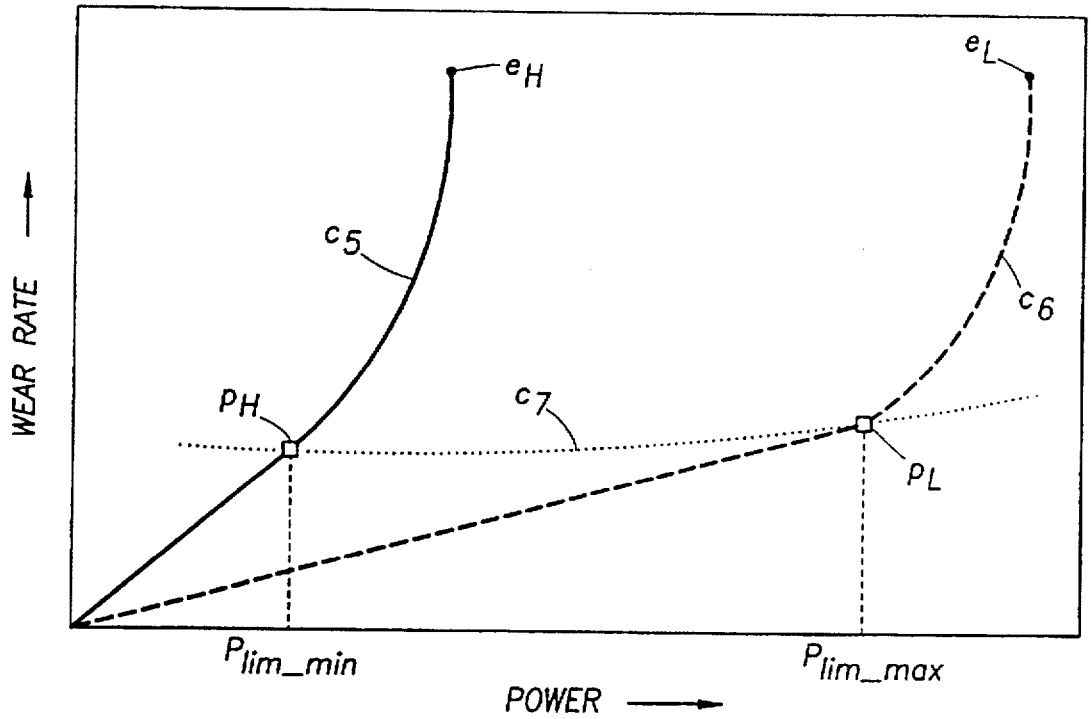
FIG. 7 is a graphic illustration of power limits.

In FIG. 7, wear rate for the bit design in question is plotted as a function of power for high and low rock compressive strengths in curves $c_5$ and $c_6$, respectively. It can be seen that in either case wear rate increases linearly with power to a respective critical point $p_H$ or $p_L$ beyond which the wear rate increases exponentially. This severe wear is due to increasing frictional forces, elevated temperature, and increasing vibration intensity (impulse loading). Catastrophic wear occurs at the ends $e_H$ and $e_L$, of the curves under steady state conditions, or may occur between $p_H$ and $e_H$ (or between $p_L$ and $e_L$) under high impact loading due to excessive vibrations. Operating at power levels beyond the critical points $p_H$, $p_L$ exposes the bit to accelerated wear rates that are no longer proportional to power and significantly increases the risk of catastrophic wear. A limiting power curve $c_7$ may be derived empirically by connecting the critical points at various rock strengths. Note that this power curve is also a function of cutter (or tooth) metallurgy and diamond quality, but these factors are negligible, as a practical matter. The curve $c_7$ defines the limiting power that avoids exposure of the bit to severe wear rates.

Once the limiting power for the appropriate rock strength is thus determined, the corresponding maximum force limit may be extrapolated by simply dividing this power by the rate of penetration.

Alternatively, the actual bit power could be compared directly to the power limit.

Of course, all of the above, including generation of signals corresponding to curves $c_5$, $c_6$ and $c_7$, extrapolation of a signal corresponding to the maximum force limit, and comparing the limit signal, may be done electronically by computer 16 after it has been inputted with signals corresponding to appropriate historical data.

Other factors can also affect the intensity of the vibrations, and these may also be taken into account in preferred embodiments. Such other factors include the ratio of weight on bit to rotary speed, drill string geometry and rigidity, hole geometry, and the mass of the bottom hole assembly below the neutral point in the drill string.

The manner of generating the peak force signal may be the same as that described above in generating incremental actual force signals for increments in which there is no vibration problem, i.e. using the electronic equivalents of equations (2), (3), or (4)+(5), except that for each of the variables, e.g. w, the maximum or peak value of that variable for the interval in question will be used (but for R, for which the minimum value should be used).

One use of the rated work relationship is in further developing information on abrasivity, as indicated at 48. Abrasivity, in turn, can be used to enhance several other aspects of the invention, as described below.

As for the abrasivity per se, it is necessary to have additional historical data, more specifically abrasivity data 50, from an additional well or hole 52 which has been drilled through an abrasive stratum such as "hard stringer" 54, and the bit 56 which drilled the interval including hard stringer 54.

It should be noted that, as used herein, a statement that a portion of the formation is "abrasive" means that the rock in question is relatively abrasive, e.g. quartz or sandstone, by way of comparison to shale. Rock abrasivity is essentially a function of the rock surface configuration and the rock strength. The configuration factor is not necessarily related to grain size, but rather than to grain angularity or "sharpness." Turning again to FIG. 1, the abrasivity data 50 include the same type of data 58 from the well 52 as data 14, i.e. those well data necessary to determine work, as well as a wear measurement 60 for the bit 56. In addition, the abrasivity data include the volume 62 of abrasive medium 54 drilled by bit 56. The latter can be determined in a known manner by analysis of well logs from hole 62, as generally indicated by the black box 64.

As with other aspects of this invention, the data are converted into respective electrical signals inputted into the computer 16 as indicated at 66. The computer 16 quantifies abrasivity by processing the signals to perform the electronic equivalent of solving the equation:

$$\lambda=(\Omega_{rated}-\Omega_b)/V_{abr} \quad (7)$$

where:

$\lambda$=abrasivity $\Omega_b$=actual bit work (for amount of wear of bit 56)

$\Omega_{rated}$=rated work (for the same amount of wear)

$V_{abr}$=volume of abrasive medium drilled

Figure 3:
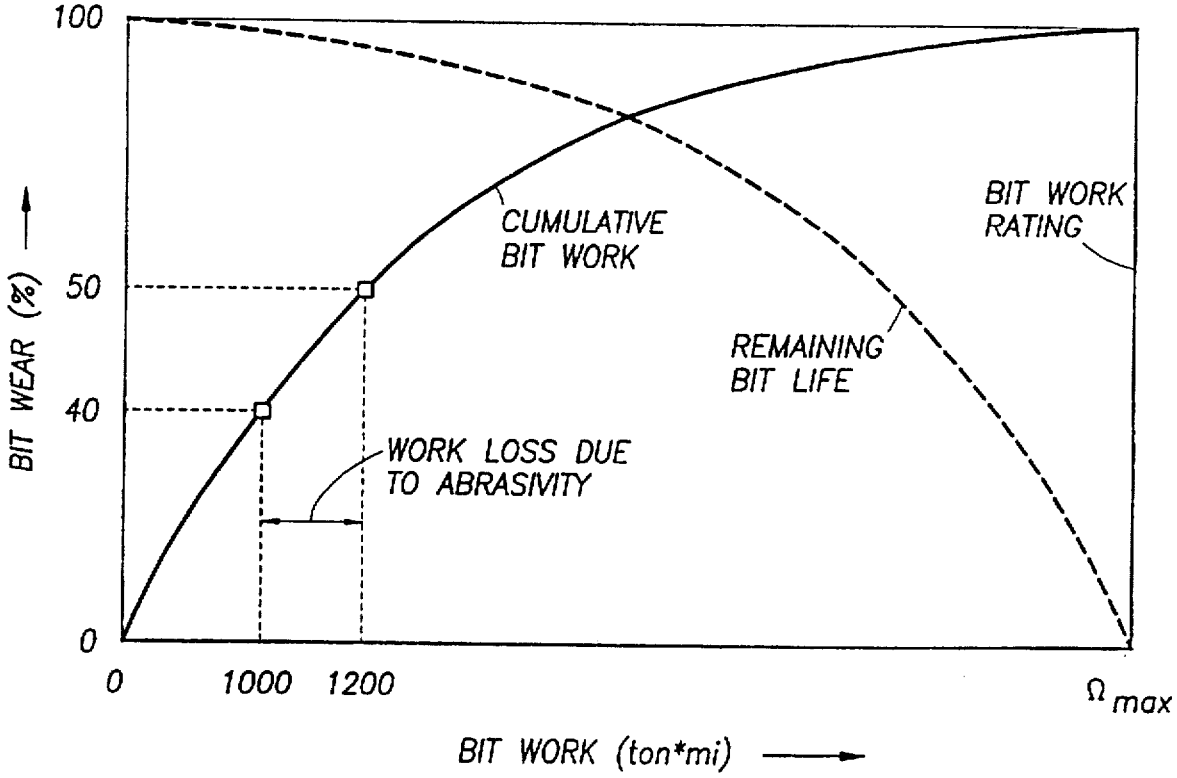
FIG. 3 is a graphic illustration of work loss due to formation abrasivity.

For instance, suppose that a bit has done 1,000 ton-miles of work and is pulled with 50% wear after drilling 200 cubic feet of abrasive medium. Suppose also that the historical rated work relationship for that particular bit indicates that the wear should be only 40% at 1,000 ton-miles and 50% at 1,200 ton-miles of work as indicated in FIG. 3. In other words, the extra 10% of abrasive wear corresponds to an additional 200 ton-miles of work. Abrasivity is quantified as a reduction in bit life of 200 ton-miles per 200 cubic feet of abrasive medium drilled or 1 (ton*mile/ft$^3$). This unit of measure is dimensionally equivalent to laboratory abrasivity tests. The volume percent of abrasive medium can be determined from well logs that quantify lithologic component fractions. The volume of abrasive medium drilled may be determined by multiplying the total volume of rock drilled by the volume fraction of the abrasive component. Alternatively, the lithological data may be taken from logs from hole 52 by measurement while drilling techniques as indicated by black box 64.

The rated work relationship 38 and, if appropriate, the abrasivity 48, can further be used to remotely model the wear of a bit 68 of the same size and design as bits 10, 28, 30 and 56 but in current use in drilling a hole 70. In the exemplary embodiment illustrated in FIG. 1, the interval of hole 70 drilled by bit 68 extends from the surface through and beyond the hard stringer 54.

Using measurement while drilling techniques, and other available technology, the type of data generated at 14 can be generated on a current basis for the well 70 as indicated at 72. Because this data is generated on a current basis, it is referred to herein as "real time data." The real time data is converted into respective electrical signals inputted into computer 16 as indicated at 74. Using the same process as for the historical data, i.e. the process indicated at 34, the computer can generate incremental actual force signals and corresponding incremental distance signals for every increment drilled by bit 68. Further, the computer can process the incremental actual force signals and the incremental distance signals for bit 68 to produce a respective electrical incremental actual work signal for each increment drilled by bit 68, and periodically cumulate these incremental actual work signals. This in turn produces an electrical current work signal corresponding to the work which has currently been done by bit 68. Then, using the signals corresponding to the rated work relationship 38, the computer can periodically transform the current work signal to an electrical current wear signal indicative of the wear on the bit in use, i.e. bit 68.

These basic steps would be performed even if the bit 68 was not believed to be drilling through hard stringer 54 or other abrasive stratum. Preferably, when the current wear signal reaches a predetermined limit, corresponding to a value at or below the work rating for the size and design bit in question, bit 68 is retrieved.

Because well 70 is near well 52, and it is therefore logical to conclude that bit 68 is drilling through hard stringer 54, the abrasivity signal produced at 48 is processed to adjust the current wear signal produced at 74 as explained in the abrasivity example above.

Once again, it may also be helpful to monitor for excessive vibrations of the bit 68 in use. If such vibrations are detected, a respective peak force signal should be generated, as described above, for each respective increment in which such excessive vibrations are experienced. Again, a limit corresponding to the maximum allowable force for the rock strength of each of these increments is also determined and a corresponding signal generated. Computer 16 electronically compares each such peak force signal to the respective limit signal to assay possible wear in excess of that corresponding to the current wear signal. Remedial action can be taken. For example, one may reduce the operating power level, i.e. the weight on bit and/or rotary speed.

In any case, the current wear signal is preferably outputted in some type of visually perceptible form as indicated at 76.

As indicated, preferred embodiments include real time wear modeling of a bit currently in use, based at least in part on data generated in that very drilling operation. However, it will be appreciated that, in less preferred embodiments, the work 54, rated work relationship 66, and/or abrasivity 68 generated by the present invention will still be useful in at least estimating the time at which the bit should be retrieved; whether or not drilling conditions, such as weight-on-bit, rotary speed, etc. should be altered from time to time; and the like. The same is true of efficiency 78, to be described more fully below, which, as also described more fully below, can likewise be used in generating the wear model 74.

In addition to the rated work relationship 38, the work signals produced at 34 can also be used to assay the mechanical efficiency of bit size and type 10, as indicated at 78.

Specifically, a respective electrical incremental minimum force signal is generated for each increment of a well interval, such as I to T, which has been drilled by bit 10. The computer 16 can do this by processing the appropriate signals to perform the electronic equivalent of solving the equation:

$$F_{min}=\sigma_i A_b \quad (8)$$

where:

$F_{min}$=minimum force required to drill increment $\sigma_i$=in-situ rock compressive strength $A_b$=total cross-sectional-area of bit The total in-situ rock strength opposing the total drilling force may be expressed as:

$$\sigma_i=f_t\sigma_{it}+f_a\sigma_{ia}+f_L\sigma_{iL} \quad (9)$$

and, $$1=f_t+f_a+f_L \quad (10)$$

where:

$\sigma_i$=in-situ rock strength opposing the total bit force $f_t$=torsional fraction of the total bit force (applied force)

$\sigma_{it}$=in-situ rock strength opposing the torsional bit force $f_a$=axial fraction of the total bit force (applied force)

$\sigma_{ia}$=in-situ rock strength opposing the axial bit force $f_L$=lateral fraction of the total bit force (reactive force, often zero mean value, negligible with BHA stabilization)

$\sigma_{iL}$=in-situ rock strength opposing the lateral bit force. Since the torsional fraction dominates the total drilling force (i.e. $f_t$ is approximately equal to 1), in the in-situ rock strength is essentially equal to the torsional rock strength, or $\sigma_i=\sigma_{it}$.

A preferred method of modelling $\Omega_i$ is explained in the present inventors' copending application Ser. No. 08/621,412, entitled "Method of Assaying Compressive Strength of Rock," filed contemporaneously herewith, and incorporated herein by reference.

The minimum force signals correspond to the minimum force theoretically required to fail the rock in each respective increment, i.e. hypothesizing a bit with ideal efficiency.

Next, these incremental minimum force signals and the respective incremental distance signals are processed to produce a respective incremental minimum work signal for each increment, using the same process as described in connection with box 34.

Finally, the incremental actual work signals and the incremental minimum work signals are processed to produce a respective electrical incremental actual efficiency signal for each increment of the interval I-T (or any other well increment subsequently so evaluated). This last step may be done by simply processing said signals to perform the electronic equivalent of taking the ratio of the minimum work signal to the actual work signal for each respective increment.

It will be appreciated, that in this process, and many of the other process portions described in this specification, certain steps could be combined by the computer 16. For example, in this latter instance, the computer could process directly from those data signals which have been described as being used to generate force signals, and then—in turn—work signals, to produce the efficiency signals, and any such "short cut" process will be considered the equivalent of the multiple steps set forth herein for clarity of disclosure and paralleled in the claims, the last-mentioned being one example only.

As a practical matter, computer 16 can generate each incremental actual efficiency signal by processing other signals already defined herein to perform the electronic equivalent of solving the following equation:

$$E_b=(\sigma_{it}f_t+\sigma_{ia}f_a+\sigma_{iL}f_L)A_b/(2\pi T/d_c+w+F_i+f_L) \quad (11)$$

However, although equation 11 is entirely complete and accurate, it represents a certain amount of overkill, in that some of the variables therein may, as a practical matter, be negligible. Therefore, the process may be simplified by dropping out the lateral efficiency, resulting in the equation:

$$E_b=(\sigma_{it}f_t+\sigma_{ia}f_a)A_b/(2\pi T/dc+w+F_i) \quad (12)$$

or even further simplified by also dropping out axial efficiency and other negligible terms, resulting in the equation:

$$E_b=\sigma_{it}(d_c/T)(A_b/2\pi) \quad (13)$$

Other equivalents to equation (11) include:

$$E_b=A_b(\sigma_{it}f_t^2/F_t+\sigma_{ia}f_a^2/F_a+\sigma_{iL}f_L^2/F_L) \quad (14)$$

The efficiency signals may be outputted in visually perceptible form, as indicated at 80.

As indicated by line 82, the efficiency model can also be used to embellish the real time wear modeling 74, described above. More particularly, the actual or real time work signals for the increments drilled by bit 68 may be processed with respective incremental minimum work signals from reference hole 52 to produce a respective electrical real time incremental efficiency signal for each such increment of hole 70, the processing being as described above. As those of skill in the art will appreciate (and as is the case with a number of the sets of signals referred to herein) the minimum work signals could be produced based on real time data from hole 70 instead of, or in addition to, data from reference hole 52.

These real time incremental efficiency signals are compared, preferably electronically by computer 16, to the respective incremental "actual" efficiency signals based on prior bit and well data. If the two sets of efficiency signals diverge over a series of increments, the rate of divergence can be used to determine whether the divergence indicates a drilling problem, such as catastrophic bit failure or balling up, on the one hand, or an increase in rock abrasivity, on the other hand. This could be particularly useful in determining, for example, whether bit 68 in fact passes through hard stringer 54 as anticipated and/or whether or not bit 68 passes through any additional hard stringers. Specifically, if the rate of divergence is high, i.e. if there is a relatively abrupt change, a drilling problem is indicated. On the other hand, if the rate of divergence is gradual, an increase in rock abrasivity is indicated.

A decrease in the rate of penetration (without any change in power or rock strength) indicates that such an efficiency divergence has begun. Therefore, it is helpful to monitor the rate of penetration while bit 68 is drilling, and using any decrease(s) in the rate of penetration as a trigger to so compare the real time and actual efficiency signals.

Figure 4:
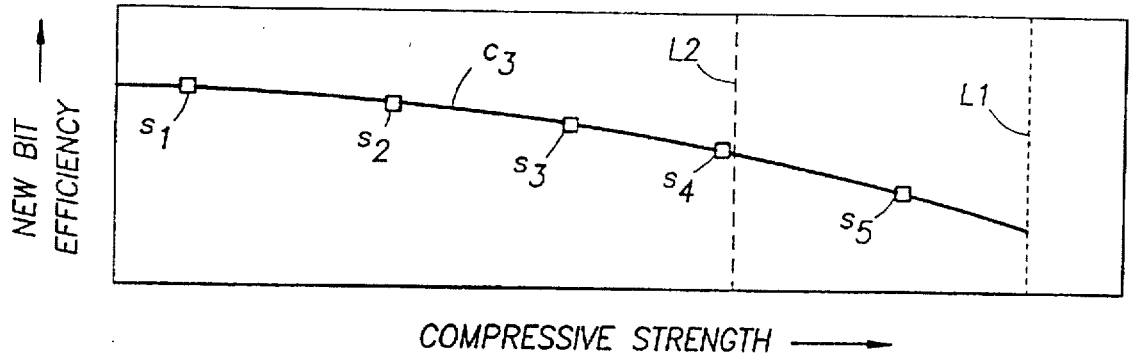
FIG. 4 is a graphic illustration of a relationship between rock compressive strength and bit efficiency.
Figure 5:
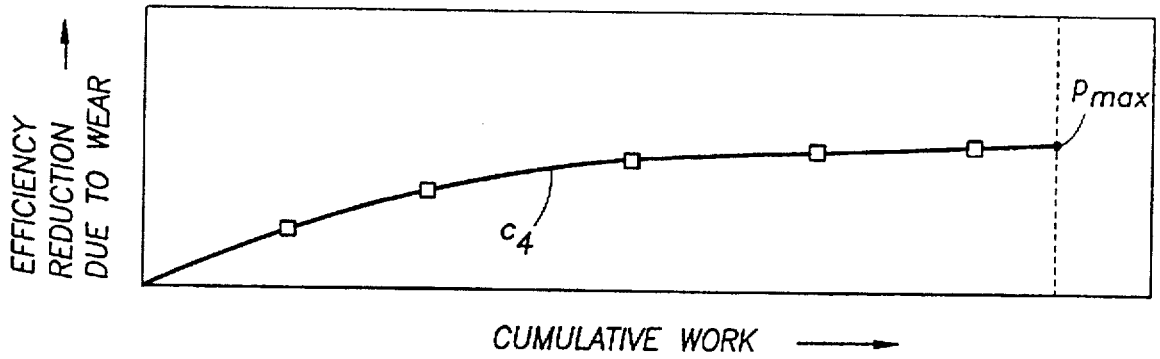
FIG. 5 is a graphic illustration of a relationship between cumulative work done by a bit and reduction in the efficiency of that bit due to wear.

Efficiency 78 can also be used to other purposes, as graphically indicated in FIGS. 4 and 5. Referring first to FIG. 4, a plurality of electrical compressive strength signals, corresponding to difference rock compressive strengths actually experienced by the bit, may be generated. Each of these compressive strength signals is then correlated with one of the incremental actual efficiency signals corresponding to actual efficiency of the bit in an increment having the respective rock compressive strength. These correlated signals are graphically represented by points $s_1$ through $s_5$ in FIG. 4. By processing these, computer 16 can extrapolate one series of electrical signals corresponding to a continuous efficiency-strength relationship, graphically represented by the curve $c_3$, for the bit size and design in question. In the interest of extrapolating a smooth and continuous function $c_3$, it may be that the curve $c_3$ does not pass precisely through each of the points from which it was extrapolated, i.e. that the one series of electrical signals does not include precise correspondents to each pair of correlated signals $s_1$ through $s_5$.

Through known engineering techniques, it is possible to determine a rock compressive strength value, graphically represented by $L_1$, beyond which the bit design in question cannot drill, i.e. is incapable of significant drilling action and/or at which bit failure will occur. The function $c_3$ extrapolated from the correlated signals may be terminated at the value represented by $L_1$. In addition, it may be helpful, again using well known engineering techniques, to determine a second limit or cutoff signal, graphically represented by $L_2$, which represents an economic cutoff, i.e. a compressive strength beyond which it is economically impractical to drill, e.g. because the amount of progress the bit can make will not justify the amount of wear.

Referring also to FIG. 5, it is possible for computer 16 to extrapolate, from the incremental actual efficiency signals and the one series of signals represented by curve $c_3$, another series of electrical signals, graphically represented by curve $c_4$ in FIG. 5, corresponding to a continuous relationship between cumulative work done and efficiency reduction due to wear for a given rock strength. This also may be developed from historical data. The end point $P_{max}$, representing the maximum amount of work which can be done before bit failure, is the same as the like-labeled point in FIG. 2. Other curves similar to $c_4$ could be developed for other rock strengths in the range covered by FIG. 4.

Referring again to FIG. 1, it is also possible for computer 16 to process signals already described below to produce a signal corresponding to the rate of penetration, abbreviated "ROP," and generally indicated at 81. As mentioned above, there is a fundamental relationship between penetration rate and power. This relationship is, more specifically, defined by the equation:

$$R=P_{Lim}E_b/\sigma_r A_b \tag{15}$$

it will be appreciated that all the variables in this equation from which the penetration rate, R, are determined, have already been defined, and in addition, will have been converted into corresponding electrical signals inputted into computer 16. Therefore, computer 16 can determine penetration rate by processing these signals to perform the electronic equivalent of solving equation 15.

The most basic real life application of this is in predicting penetration rate, since means are already known for actually measuring penetration rate while drilling. One use of such a prediction would be to compare it with the actual penetration rate measured while drilling, and if the comparison indicates a significant difference, checking for drilling problems.

A particularly interesting use of the rated work relationship 38, efficiency 78 and its corollaries, and ROP 81 is in determining whether a bit of the design in question can drill a significant distance in a given interval of formation, and if so, how far and/or how fast. This can be expanded to assess a number of different bit designs in this respect, and for those bit designs for which one or more of the bits in question can drill the interval, an educated bit selection 42 can be made on a cost-per-unit-length-of-formation-drilled basis. The portion of the electronic processing of the signals involved in such determinations of whether or not, or how far, a bit can drill in a given formation, are generally indicated by the bit selection block 42 in FIG. 1. The fact that these processes utilize the rated work relationship 38, efficiency 78, and ROP 81 is indicated by the lines 44, 83, and 82, respectively. The fact that these processes result in outputs is indicated by the line 46.

Figure 6:
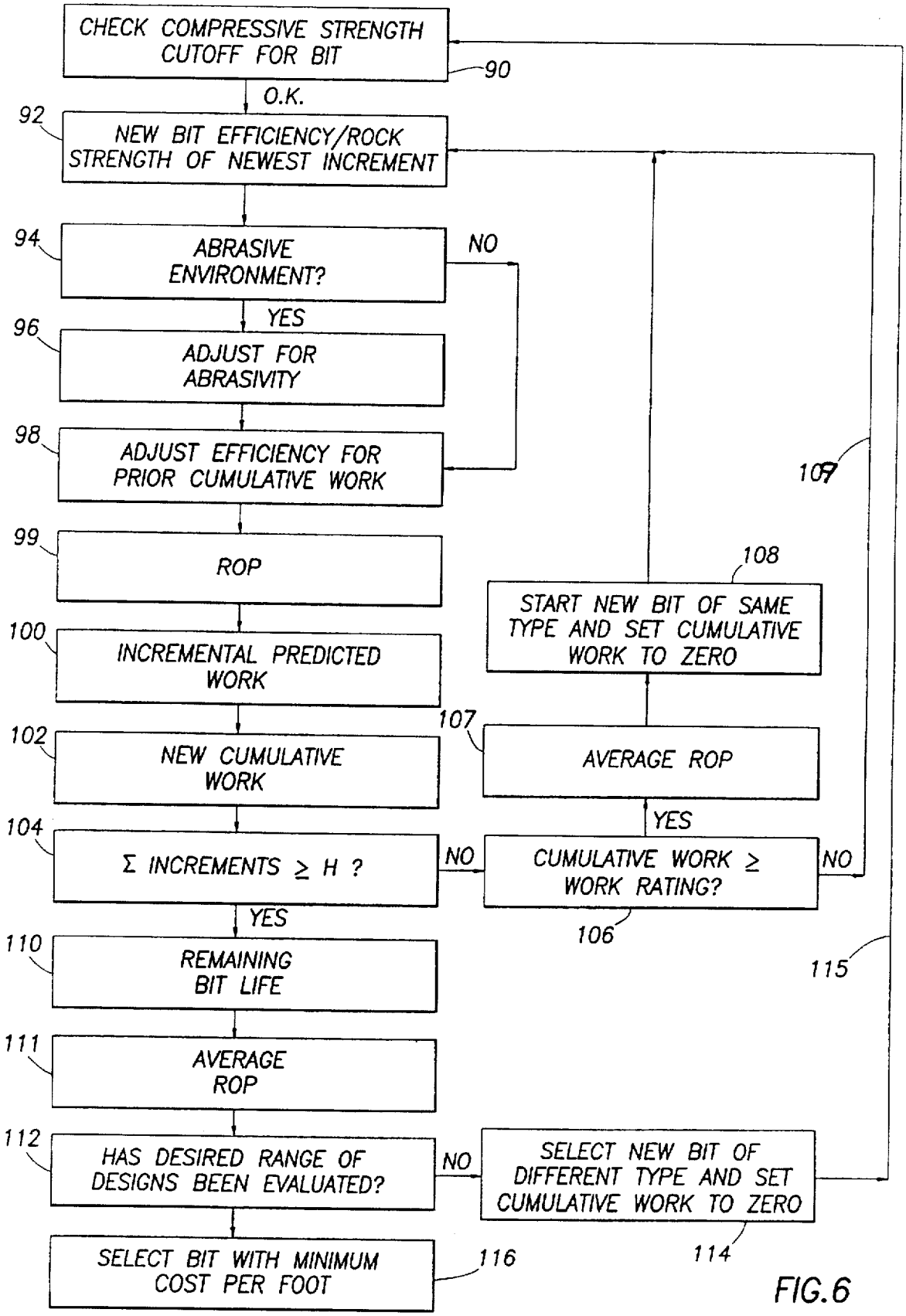
FIG. 6 is diagram generally illustrating a bit selection process.

FIG. 6 diagrams a decision tree, interfaced with the processes which can be performed by computer 16 at 42, for a preferred embodiment of this aspect of the invention. The interval of interest is indicated by the line H in FIG. 1, and due to its proximity to holes 52 and 70, presumptively passes through hard stringer 54.

First, as indicated in block 90, the maximum rock compressive strength for the interval H of interest is compared to a suitable limit, preferably the value at $L_2$ in FIG. 4, for the first bit design to be evaluated. The computer 16 can do this by comparing corresponding signals. If the rock strength in the interval H exceeds this limit, then the bit design in question is eliminated from consideration. Otherwise, the bit has "O.K." status, and we proceed to block 92. The interval H in question will have been subdivided into a number of very small increments, and corresponding electrical signals will have been inputted into the computer 16. For purposes of the present discussion, we will begin with the first two such increments. Through the processes previously described in connection with block 78 in FIG. 1, an efficiency signal for a new bit of the first type can be chosen for the rock strength of the newest increment in interval H, which in this early pass will be the second of the aforementioned two increments.

Preferably, computer 16 will have been programmed so that those increments of interval H which presumptively pass through hard stringer 54 will be identifiable. In a process diagrammatically indicated by block 94, the computer determines whether or not the newest increment, here the second increment, is abrasive. Since the second increment will be very near the surface or upper end of interval H, the answer in this pass will be "no."

The process thus proceeds directly to block 98. If this early pass through the loop is the first pass, there will be no value for cumulative work done in preceding increments. If, on the other hand, a first pass was made with only one increment, there may be a value for the work done in that first increment, and an adjustment of the efficiency signal due to efficiency reduction due to that prior work may be done at block 98 using the signals diagrammatically indicated in FIG. 5. However, even in this latter instance, because the increments are so small, the work and efficiency reduction from the first increment will be negligible, and any adjustment made is insignificant.

As indicated at block 99, the computer will then process the power limit, efficiency, in situ rock strength, and bit cross sectional area signals, to model the rate of penetration for the first two increments (if this is the very first pass through the loop) or for the second increment (if a first pass was made using the first increment only). In any case, each incremental ROP signal may be stored. Alternatively, each incremental ROP signal may be transformed to produce a corresponding time signal, for the time to drill the increment in question, and the time signals may be stored. It should be understood that this step need not be performed just after step box 98, but could, for example, be performed between step boxes 102 and 104, described below.

Next, as indicated at block 100, the computer will process the efficiency signals for the first two increments (or for the second increment if the first one was so processed in an earlier pass) to produce respective electrical incremental predicted work signals corresponding to the work which would be done by the bit in drilling the respective increments. This can be done, in essence, by a reversal of the process used to proceed from block 34 to block 78 in FIG. 1.

As indicated at block 102, the computer then cumulates the incremental predicted work signals for these first two increments to produce a cumulative predicted work signal.

As indicated at block 104, signals corresponding to the lengths of the first two increments are also cumulated and electronically compared to the length of the interval H. For the first two increments, the sum will not be greater than or equal to the length of H, so the process proceeds to block 106. The computer will electronically compare the cumulative work signal determined at block 102 with a signal corresponding to the work rating, i.e. the work value for $p_{max}$ (FIG. 2) previously determined at block 38 in FIG. 1. For the first two increments, the cumulative work will be negligible, and certainly not greater than the work rating. Therefore, as indicated by line 109, we stay in the main loop and return to block 92 where another efficiency signal is generated based on the rock strength of the next, i.e. third, increment. The third increment will not yet be into hard stringer 54, so the process will again proceed directly from block 94 to block 98. Here, the computer will adjust the efficiency signal for the third increment based on the prior cumulative work signal generated at block 102 in the preceding pass through the loop, i.e. adjusting for work which would be done if the bit had drilled through the first two increments. The process then proceeds as before.

For those later increments, however, which do lie within hard stringer 54, the programming of computer 16 will, at the point diagrammatically indicated by block 94, trigger an adjustment for abrasivity, based on signals corresponding to data developed as described hereinabove in connection with block 48 in FIG. 1, before proceeding to the adjustment step 98.

If, at some point, the portion of the process indicated by block 106 shows a cumulative work signal greater than or equal to the work rating signal, we know that more than one bit of the first design will be needed to drill the interval H. At this point, in preferred embodiments, as indicated by step block 107, the stored ROP signals are averaged and then processed to produce a signal corresponding to the time it would have taken for the first bit to drill to the point in question. (If the incremental ROP signals have already been converted into incremental time signals, then, of course, the incremental time signals will simply be summed.) In any event, we will assume that we are now starting another bit of this first design, so that, as indicated by block 108, the cumulative work signal will be set back to zero before proceeding back to block 92 of the loop.

On the other hand, eventually either the first bit of the first design or some other bit of that first design will result in an indication at block 104 that the sum of the increments is greater than or equal to the length of the interval H, i.e. that the bit or set of bits has hypothetically drilled the interval of interest. In this case, the programming of computer 16 will cause an appropriate indication, and will also cause the process to proceed to block 110, which diagrammatically represents the generation of a signal indicating the remaining life of the last bit of that design. This can be determined from the series of signals diagrammatically represented by curve $c_2$ in FIG. 2.

Next, as indicated by step block 111, the computer performs the same function described in connection with step block 107, i.e. produce a signal indicating the drilling time for the last bit in this series (of this design).

Next, as indicated by block 112, the operator will determine whether or not the desired range of designs has been evaluated. As described thus far, only a first design will have been evaluated. Therefore, the operator will select a second design, as indicated at block 114. Thus, not only is the cumulative work set back to zero, as in block 108, but signals corresponding to different efficiency data, rated work relationship, abrasivity data, etc., for the second design will be inputted, replacing those for the first design, and used in restarting the process. Again, as indicated by 115, the process of evaluating the second design will proceed to the main loop only if the compressive strength cutoff for the second design is not exceeded by the rock strength within the interval H.

At some point, at block 112, the operator will decide that a suitable range of bit designs has been evaluated. We then proceed to block 116, i.e. to select the bit which will result in the minimum cost per foot for drilling interval H. It should be noted that this does not necessarily mean a selection of the bit which can drill the farthest before being replaced. For example, there may be a bit which can drill the entire interval H, but which is very expensive, and a second bit design, for which two bits would be required to drill the interval, but with the total cost of these two bits being less than the cost of one bit of the first design. In this case, the second design would be chosen.

More sophisticated permutations may be possible in instances where it is fairly certain that the relative abrasivity in different sections of the interval will vary. For example, if it will take at least three bits of any design to drill the interval H, it might be possible to make a selection of a first design for drilling approximately down to the hard stringer 54, a second and more expensive design for drilling through hard stringer 54, and a third design for drilling below hard stringer 54.

The above describes various aspects of the present invention which may work together to form a total system. However, in some instances, various individual aspects of the invention, generally represented by the various blocks within computer 16 in FIG. 1, may be beneficially used without necessarily using all of the others. Furthermore, in connection with each of these various aspects of the invention, variations and simplifications are possible, particularly in less preferred embodiments.

Accordingly, it is intended that the scope of the invention be limited only by the following claims.

What is claimed is:

1. A method of assaying work of an earth boring bit of a given size and design, comprising the steps of:

drilling a hole with the bit from an initial point to a terminal point through a given formation interval;

recording the distance between the initial and terminal points;

generating a plurality of electrical incremental actual force signals each corresponding to a force of the bit over a respective increment of the distance between the initial and terminal points;

generating a plurality of electrical incremental distance signals, each corresponding to the length of the increment for a respective one of said incremental actual force signals;

processing the incremental actual force signals and the incremental distance signals to produce a value corresponding to the total work done by the bit in drilling from the initial point to the terminal point; and using said value of total work done by the bit in the selection of a bit for drilling a hole in a formation analogous to said given formation interval.

2. The method of claim 1 comprising:

processing the incremental actual force signals and the incremental distance signals to produce an electrical weighted average force signal corresponding to a weighted average of the force exerted by the bit between the initial and terminal points; and multiplying the weighted average force by the distance between the initial and terminal points to produce said total work value.

3. The method of claim 1 comprising;

processing the incremental actual force signals and the incremental distance signals to produce a respective electrical incremental actual work signal for each of said increments; and cumulating said incremental actual work signals to produce an electrical total work signal corresponding to said total work value.

4. The method of claim 1 comprising:

developing a force/distance function by processing the incremental actual force signals and incremental distance signals, and integrating the function.

5. The method of claim 1 wherein bit vibrations cause the bit force to vary over the increment, and each incremental actual force signal corresponds to an average force of the bit for the respective increment.

6. The method of claim 1 wherein each incremental actual force signal is generated from electrical signals corresponding, respectively, to bit rotation speed, bit torque, and rate of bit penetration.

7. The method of claim 6 wherein each incremental actual force signal is also generated from electrical signals corresponding, respectively, to weight on bit and hydraulic impact force.

8. The method of claim 7 wherein each incremental actual force signal is also generated from an electrical signal corresponding to a lateral force applied to the bit while drilling the respective increment.

9. The method of claim 1 wherein each incremental actual force signal is generated from electrical signals corresponding, respectively, to bit torque and depth of cut per revolution.

10. The method of claim 1 further comprising:

determining a minimum work value for said given formation interval; and comparing said minimum work value with said total work value to assay the efficiency of said bit.

11. A method of assaying work of an earth boring bit of a given size and design, comprising the steps of:

drilling a hole with the bit from an initial point to a terminal point;

recording the distance between the initial and terminal points;

generating a plurality of electrical incremental actual force signals each corresponding to a force of the bit over a respective increment of the distance between the initial and terminal points;

generating a plurality of electrical incremental distance signals, each corresponding to the length of the increment for a respective one of said incremental actual force signals;

processing the incremental actual force signals and the incremental distance signals to produce a value corresponding to the total work done by the bit in drilling from the initial point to the terminal point;

rating the wear for bits of said size and design, wherein a plurality of such holes are drilled with respective such bits, and respective total work determined for each of the bits;

generating a respective total work signal corresponding to the total work for each of said bits;

retrieving each of the bits from its respective hole after it has reached the respective terminal point;

measuring the wear of each bit after retrieval and generating a respective wear signal;

correlating the total work signal and the wear signal for each bit; and extrapolating from the correlated total work and wear signals to generate a series of electrical signals corresponding to a continuous rated work relationship between work and wear for the bit size and design.

12. The method of claim 11 wherein said series of signals is transformed into visually perceptible form.

13. The method of claim 11 wherein bit vibrations cause the bit force to vary over the increment, and each incremental actual force signal corresponds to an average force of the bit for the respective increment.

14. The method of claim 13 further comprising:

generating a respective peak force signal corresponding to a maximum force of the bit over the respective increment;

determining a limit corresponding to a maximum allowable force for the rock strength of the respective increment; and comparing a value corresponding to the peak force signal to the limit to assay possible excessive wear.

15. The method of claim 14 wherein, if the value corresponding to the peak force signal is greater than or equal to the limit, excluding the respective bit from those from which the rated work relationship signals are generated.

16. The method of claim 14 comprising producing an electrical limit signal corresponding to the limit and electronically comparing to the limit and peak force signals.

17. The method of claim 11 wherein the rated work relationship so generated includes a correlated maximum-wear-maximum-work point.

18. The method of claim 17 comprising determining whether a first bit of said size and design can drill a given interval of formation, comprising the further steps of:

generating at least two electrical bit efficiency signals, corresponding to the rock strengths in respective, successive increments of said interval;

processing the efficiency signals to produce respective electrical incremental predicted work signals corresponding to the work which would be done by the bit in drilling the respective increments;

processing the incremental predicted work signals to produce an electrical cumulative predicted work signal corresponding to the work which could be done by the bit drilling the increments;

comparing the sum of the lengths of the increments with the length of the interval;

if the sum of the lengths of the increments is less than the length of the interval, comparing the cumulative predicted work signal to an electrical signal corresponding to the work component of the maximum-wear-maximum-work point.

19. The method of claim 18 wherein the cumulative predicted work signal is less than the signal corresponding to the work component of the maximum-wear-maximum-work point, and further comprising:

so generating at least one further efficiency signal for a next successive interval;

adjusting the further efficiency signal for efficiency reductions due to work in prior increments;

so processing the adjusted further efficiency signal to produce a respective further incremental predicted work signal;

so processing all the incremental predicted work signals to produce a new cumulative predicted work signal corresponding to the work which could be done by the bit in drilling all the increments;

so comparing the sum of the lengths of the increments to the length of the interval.

20. The method of claim 19 wherein the sum of the lengths of the increments is less than the length of the interval, and further comprising:

comparing the new cumulative predicted work signal to the signal corresponding to the work component of the maximum-wear-maximum-work point.

21. The method of claim 20 wherein the new cumulative predicted work signal is less than the signal corresponding to the work component of the maximum-wear-maximum-work point, and further comprising repeating the steps of claim 19.

22. The method of claim 20 wherein the new cumulative predicted work signal is greater than or equal to the signal corresponding to the work component of the maximum-wear-maximum-work point, and further comprising repeating the steps of claim 18 for a new bit of the same size and design, but for a new interval less than the original interval by the sum of the lengths of the increments for the first bit.

23. The method of claim 19 wherein the sum of the lengths of the increments is greater than or equal to the length of the interval, and further comprising repeating the steps of claim 18 for a first bit of a different design.

24. The method of claim 23 further comprising, for each increment, generating a signal corresponding to the penetration rate for that increment by processing signals corresponding, respectively, to a limiting power for the rock strength in question, the efficiency for the increment in question, the rock strength in the increment in question, and the transverse cross-sectional area of the bit; and, for each bit, processing the incremental penetration rate signals to produce a signal corresponding to the drilling time for the bit.

25. The method of claim 24 further comprising selecting, from the bit designs able to drill the interval in question, the bit design having the minimum cost per foot.

26. The method of claim 23 further comprising processing the new cumulative predicted work signal and the signal corresponding to the work component of the maximum-wear-maximum-work point to produce an electrical signal corresponding to the remaining useful life of the bit.

27. The method of claim 19 comprising, prior to the steps of claim 18, for at least one reference bit of the size and design of the first bit:

generating a respective electrical incremental minimum force signal corresponding to the minimum force theoretically required to fail the rock in each of said increments;

processing the incremental minimum force signals and the incremental distance signals for the reference bit to produce a respective incremental minimum work signal for each of said increments for the reference bit;

processing the incremental actual force signals and the incremental distance signals to produce a respective incremental actual work signal for each of said increments for the reference bit;

processing the incremental actual work signals and the incremental minimum work signals to produce a respective electrical incremental actual efficiency signal for each increment;

generating a plurality of electrical compressive strength signals corresponding to different rock compressive strengths; correlating each compressive strength signal with one of said incremental actual efficiency signals corresponding to efficiency of the reference bit in an increment having the respective rock compressive strength; and extrapolating from the correlated compressive strength and incremental actual efficiency signals for the reference bit to generate one series of electrical signals corresponding to a continuous efficiency-strength relationship for the bit size and design;

then, in performing the steps of claim 18 and 19; using said one series to determine the magnitude of the bit efficiency signals so generated.

28. The method of claim 27 further comprising, prior to the steps of claim 18, from said efficiency-strength relationship, determining a compressive strength cutoff above which the bit design should not attempt to drill, and comparing the cutoff to the rock strengths in said given interval, and proceeding with the steps of claim 18 for said first bit only if the rock strengths in said given interval are less than or equal to said cutoff.

29. The method of claim 27 further comprising, prior to the steps of claim 18;

from said incremental actual efficiency signals for the reference bit and said one series of signals, extrapolating at least one other series of electrical signals corresponding to a continuous relationship between cumulative work done and efficiency reduction due to wear for a respective one of the rock strengths in said given interval; and in performing the steps of claims 18 and 19, using said other series to so adjust the efficiency signals.

30. The method of claim 18 further comprising:

assaying the abrasivity of the rock in the interval; and further adjusting the incremental predicted work signals for increased wear due to abrasivity.

31. The method of claim 11 wherein each of said holes is drilled through a relatively non-abrasive medium, and further comprising determining the abrasivity of the rock drilled in a given section of another hole with another such bit by:

measuring the wear of said other bit after drilling said section of said other hole;

from said rated work relationship, selecting a value corresponding to the wear of the other bit and generating the corresponding electrical rated work signal;

determining the volume of the abrasive rock drilled in said section of said other hole and generating a corresponding electrical abrasive volume signal;

generating an electrical actual work signal corresponding to the work done by said other bit in drilling said section of said other hole; and processing the actual work signal for said other bit, the rated work signal for said other bit, and the abrasive volume signal to produce an electrical abrasivity signal.

32. The method of claim 31 wherein the volume of abrasive rock drilled in said other hole is determined by processing electrical signals corresponding to lithological data.

33. The method of claim 32 wherein the lithological data are taken from logs from nearby wells.

34. The method of claim 32 wherein the lithological data are taken from said other hole by measurement while drilling techniques.

35. The method of claim 11 further comprising remotely modelling wear of such a bit in use in a current hole being drilled by:

a so generating respective incremental actual force signals and incremental distance signals for every increment drilled by said bit-in-use;

processing the incremental actual force signals and the incremental distance signals for the bit-in-use to produce a respective electrical incremental actual work signal for each increment drilled by said bit-in-use;

periodically cumulating said incremental actual work signals to produce an electrical current work signal corresponding to the work which has currently been done by the bit-in-use; and using said rated work relationship, periodically transforming said current work signal to an electrical current wear signal indicative of the wear on the bit-in-use.

36. The method of claim 35 further comprising retrieving said bit-in-use when said current wear signal reaches a predetermined limit.

37. The method of claim 35 wherein, if a reference section of a reference hole, adjacent said current hole, drilled by a reference bit, contained relatively abrasive material:

measuring the wear of the reference bit;

from said rated work relationship, selecting a value corresponding to the wear of the reference bit and generating the corresponding electrical rated work signal;

determining the volume of the abrasive rock drilled in said reference section and generating a corresponding electrical abrasive volume signal;

generating an electrical actual work signal corresponding to the work done by the reference bit; and processing the actual work signal for said reference bit, the rated work signal for said reference bit, and the abrasive volume signal to produce an electrical abrasivity signal; and processing the abrasivity signal to adjust the current wear signal.

38. The method of claim 35 wherein vibrations of the bit in use cause the bit force to vary over the increment, and further comprising:

generating a respective peak force signal corresponding to a maximum force of the bit over the respective increment;

determining a limit corresponding to a maximum allowable force for the rock strength of the respective increment;

comparing a value corresponding to the peak force signal to the respective limit to assay possible wear in excess of that corresponding to the current wear signal.

39. The method of claim 36 comprising generating a respective electrical incremental actual efficiency signal, for each increment, corresponding to the efficiency of the bit under normal drilling conditions.

40. The method of claim 39 comprising:

generating a respective electrical incremental minimum force signal corresponding to the minimum force theoretically required to fail the rock in each of said increments;

processing the incremental minimum force signals and the incremental distance signals to produce a respective incremental minimum work signal for each of said increments;

processing the incremental actual force signals and the incremental distance signals to produce a respective incremental actual work signal for each of said increments; and processing the incremental actual work signals and the incremental minimum work signals to produce the respective electrical incremental actual efficiency signal for each increment.

41. The method of claim 40 further comprising:

for an additional hole currently being drilled by an additional such bit, generating electrical real time incremental distance and force signals and so processing those signals to produce a series of electrical real time incremental work signals;

processing the real time incremental work signals with the respective incremental minimum work signals to produce a respective electrical real time incremental efficiency signal for each increment;

comparing the real time incremental efficiency signals to the respective incremental actual efficiency signals;

if the incremental real time efficiency and incremental actual efficiency signals diverge over a series of said increments, using the rate of divergence to determine whether the divergence indicates a drilling problem or an increase in rock abrasivity.

42. The method of claim 41 further comprising monitoring the rate of penetration while drilling, and using a decrease in the rate of penetration as a trigger to so compare the real time incremental efficiency and incremental actual efficiency signals.

43. The method of claim 40 further comprising:

generating a plurality of electrical compressive strength signals corresponding to different rock compressive strengths; correlating each compressive strength signal with one of said incremental actual efficiency signals corresponding to actual efficiency of the bit in an increment having the respective rock compressive strength; and extrapolating from the correlated compressive strength and incremental actual efficiency signals to generate one series of electrical signals corresponding to a continuous efficiency-strength relationship for the bit size and design.

44. The method of claim 43 further comprising:

from said efficiency-strength relationship, determining a compressive strength cutoff above which the bit design should not attempt to drill.

45. The method of claim 43 further comprising:

from said incremental actual efficiency signals and said one series of signals, extrapolating at least one other series of electrical signals corresponding to a continuous relationship between cumulative work done and efficiency reduction due to wear for a respective one of the rock strengths in said given interval.

46. The method of claim 39 comprising generating the actual efficiency signal by processing electrical signals corresponding respectively to:

depth of cut of the bit;

axial contact area of the bit;

weight on the bit;

torque;

in situ rock strength opposing torsional bit force;

in situ rock strength opposing axial bit force; and total transverse cross-sectional area of the bit;

all for the respective increment.

47. The method of claim 39 comprising generating the actual efficiency signal by processing electrical signals corresponding respectively to:

in situ rock strength opposing torsional bit force;

depth of cut of the bit;

torque; and total transverse cross-sectional area of the bit; all for the respective increment.

* * * * *